US006736122B2

(12) United States Patent
West

(10) Patent No.: US 6,736,122 B2
(45) Date of Patent: May 18, 2004

(54) MOTOR VEHICLE ENGINE SYNCHRONIZATION

(75) Inventor: Phillip James West, Billerlcay (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 138 days.

(21) Appl. No.: 10/104,153

(22) Filed: Mar. 22, 2002

(65) Prior Publication Data

US 2002/0139359 A1 Oct. 3, 2002

(30) Foreign Application Priority Data

Mar. 30, 2001 (GB) ..... 0108010

(51) Int. Cl.[7] ..... F02D 41/24
(52) U.S. Cl. ..... 123/690; 701/115; 73/119 A
(58) Field of Search ..... 123/688, 690, 123/691, 692, 693, 703, 704, 480; 701/103, 109, 115; 73/117.1, 117.2, 117.3, 119 A

(56) References Cited

U.S. PATENT DOCUMENTS

| | | | | |
|---|---|---|---|---|
| 5,535,135 A | | 7/1996 | Bush et al. | 123/672 |
| 5,551,410 A | | 9/1996 | Messih et al. | 123/679 |
| 5,613,473 A | * | 3/1997 | Angermaier | 123/481 |
| 6,244,248 B1 | * | 6/2001 | Halleron et al. | 123/339.12 |

FOREIGN PATENT DOCUMENTS

| | | |
|---|---|---|
| DE | 3904619 A1 | 8/1990 |
| EP | 0 277 826 | 8/1988 |
| EP | 0 990 787 A2 | 4/2000 |
| JP | 11-107814 | 4/1999 |

* cited by examiner

*Primary Examiner*—Hai Huynh
(74) *Attorney, Agent, or Firm*—Brinks Hofer Gilson & Lione

(57) ABSTRACT

The invention relates to a four stroke internal combustion engine with one or more engine operating condition sensors including an exhaust gas composition sensor in the exhaust conduit. An engine management system is arranged to control the operation of the engine including the fuel injection system and the air/fuel ratio λ for at least one cylinder. The engine management system receives from said sensors respective signals $S_i$ and oscillates the air/fuel ratio λ between a relatively rich level and a relatively lean level, depending on the signal $S_i$ from the exhaust gas sensor. The engine management system determines the temporal characteristics (142) of the oscillation in the air/fuel ratio and determines whether or not the engine is being fueled on the correct stroke by comparing (136) those temporal characteristics with relevant engine operation data (120) stored in the engine management system.

8 Claims, 8 Drawing Sheets

MOTOR VEHICLE ENGINE SYNCHRONIZATION

BACKGROUND OF THE INVENTION

This invention relates to an engine management system capable of determining engine phase of a four-stroke internal combustion engine.

When a four-stroke engine is running it is desirable to verify that the fuel is being injected into the cylinder during the correct stroke. If the fuel is injected on the wrong stroke, the engine may still run, but engine emissions will increase and engine efficiency will drop.

Internal combustion engines normally have a crankshaft sensor that provides a rotation signal that can be used to verify piston position over one complete revolution of the engine. However, as the engine takes two full revolutions to complete one cycle of the four strokes, this type of engine sensor cannot distinguish between the two halves of the cycle, sometimes referred to as the charge phase in which the cylinder is charged with air and fuel, and the power phase in which the air fuel charge is ignited and expelled as exhaust gas.

Currently, the most common method of verifying the engine injection stroke is through the use of a camshaft position sensor. However, a camshaft sensor with associated wiring and engine machining adds cost to the engine.

It is possible to achieve engine stoke verification without the use of a camshaft position sensor, for example as described in patent document EP 0 990 787 A. This document describes a method of determining engine stroke in which one cylinder of the engine is made to run for one cycle at non-optimal conditions. This causes a sharp change in the operating conditions for that cylinder, which can then be detected by measuring a momentary change in the composition of the exhaust gas. The time at which the exhaust gas composition changes can then be used to determine the engine stroke on which exhaust gas is expelled by the affected cylinder.

This method suffers from a number of problems, primarily the need to operate the engine in a non-optimal manner and the need for steady state operation before, during and after the test.

SUMMARY OF THE INVENTION

The present invention seeks to provide an improved system for engine injection stroke verification.

According to the present invention there is provided an internal combustion engine, comprising a number of cylinders, the or each cylinder containing a four-stroke reciprocating piston, an exhaust conduit, one or more engine operating condition sensors including an exhaust gas sensor in the exhaust conduit for measuring the composition of the exhaust gas, a fuel injection system, and an engine management system for controlling the operation of the engine including the fuel injection system and the air/fuel ratio for at least one cylinder, wherein the engine management system contains engine operation data, the engine operation data being related to expected engine operation with engine fueling on the correct stroke and/or engine fueling on an incorrect stroke, and the engine management system is arranged to:

a) receive from said sensor(s) respective signal(s);

b) oscillate the air/fuel ratio between a relatively rich level and a relatively lean level, the exhaust gas composition varying depending on the air/fuel ratio;

c) reverse the direction of change of the air/fuel ratio when the exhaust gas composition is sensed as being indicative of rich engine operation or lean engine operation;

d) determine the temporal characteristics of the oscillation in the air/fuel ratio; and e) determine whether or not the engine is being fueled on the correct stroke by comparing said temporal characteristics with said relevant engine operation data.

This procedure provides the advantage that there is no need for a camshaft position sensor, and the engine is no longer required to operate in a non-optimal manner to provide the engine management with the signals required to verify whether or not the engine is being fueled on the correct stroke by comparing.

The term "engine management system" will be understood to mean any electronic system capable of controlling or influencing the operation of the engine.

The term "temporal characteristics" should be understood as meaning period or frequency or any other time dependent characteristic that could be used to characterise an oscillating system.

It should be understood that the term "measure exhaust gas composition" means to measure one or more of the composition characteristics of the exhaust gas composition such as the concentration of one or more of the component gases.

In order to meet modern emission standards, engine control systems utilize a form of closed loop control to control the air/fuel ratio of the cylinder charge. The use of closed loop control is dictated by the use of three way catalytic converters which require very accurate control of the air/fuel ratio around a stoichiometric value in order to operate at their maximum efficiency. Closed loop control uses feedback from a sensor at an output from a system to control an input to the system that affects the signal from the output, sensor. In this case the output sensor measures the exhaust gas composition and the engine management system varies the air/fuel ratio accordingly. In open loop control the engine management system does not take account of the signal from the exhaust gas sensor when setting the air/fuel ratio. Open loop control may occur, for instance, when the driver presses the throttle.

A simplified model of a three way catalyst is that of an oxygen storage device. When the engine air fuel ratio is lean, the exhaust gas is rich in $NO_x$ gases and the oxygen storage sites in the catalyst remove the oxygen in the $NO_x$ gasses to create harmless $N_2$. Some of the excess oxygen in the exhaust gases is also stored in this phase. When the air fuel ratio is rich, the exhaust gases are rich in hydrocarbons HC, CO and $H_2$. The oxygen stored on the catalyst is then released to react with these gases to form $CO_2$ and $H_2O$.

To measure the exhaust gas composition, it is common to use a Heated Exhaust Gas Oxygen (HEGO) sensor. Commonly available HEGO sensors have a steep change in output around the oxygen concentration resulting from near stoichiometric air/fuel ratio. This results in the HEGO sensor being used in a bi-stable manner to detect either rich or lean combustion, rather than provide an absolute indication of air/fuel ratio.

In a closed loop feedback system this bi-stable HEGO sensor is ideally suited to a limit cycle operation oscillating the air/fuel ratio about the stoichiometric value. The present invention takes advantage of the fact that there is already a slight oscillation in engine operating conditions to determine whether or not the engine is being fueled on the correct stroke. For this invention to be applicable there is no need for the engine to be fitted with a catalyst, but the invention is particularly suited to an engine that does have a catalyst fitted.

The engine management system may calculate a transport delay time from the period or frequency of the reversal of the oscillation in the air/fuel ratio, this being indicative of the time taken for a change in engine operating conditions to alter the composition of the exhaust gas at the exhaust gas sensor. This transport delay, time may then be compared with the engine operation data stored in the engine management system to determine whether or not the engine is being fueled on the correct stroke.

The exhaust sensor may be an exhaust gas oxygen sensor, but may be any other sensor capable of detecting changes in the composition of the exhaust gases that relate to a change in the air/fuel ratio in the engine.

These types of sensors are common in the field and can be obtained cheaply. It is also usual for the engine to have an exhaust gas oxygen sensor in the exhaust conduit as part of the engine management system and this method would simply make greater use of it.

The period or frequency of the reversal cycle data may be averaged over a plurality of oscillations in the air/fuel ratio. This reduces the effect of signal noise inherent in real systems so that the data used in comparisons is more reliable.

The period or frequency data of an oscillation in the air/fuel ratio may be ignored by the engine management system if said period or frequency is outside a predetermined range. Large signal errors and instances of open loop control can then be ignored by the engine management system so these errors do not alter the final results.

The engine management system may have a range of pre-determined engine operating conditions during which it calculates the period or frequency of the reversal cycle or the transport delay and stores this for future reference. This avoids errors in readings taken at extremes of the operating range of the engine.

The stored, period or frequency of the reversal cycle or the transport delay is used to calculate an average error for those particular engine operating conditions for which data is recorded. The engine management system is then used to determine whether or not the engine is being fueled on the correct stroke by comparing said temporal characteristics with said relevant engine operation data. This provides the same benefits as the averaging operation described above.

The fuel injection system may be a direct injection system, in which fuel is injected directly in to the cylinders. In a preferred embodiment of the invention, however, the fuel injection system is an indirect injection system in which fuel is injected into an inlet port for each cylinder.

According to another aspect of the invention there is provided a method of operating an internal combustion engine the engine comprising a number of cylinders, the or each cylinder containing a four-stroke reciprocating piston, one or more engine operating condition sensors including an exhaust gas sensor, a fuel injection system, and an engine management system, wherein the engine management system contains engine operation data, the engine operation data being related to expected engine operation with engine fueling on the correct stroke and/or engine fueling on an incorrect stroke, wherein the method comprises the steps of:

a) using the engine management system to control the operation of the engine including the fuel injection system and the air/fuel ratio for at least one cylinder;

b) sending to the engine management system from said sensor(s) respective signal(s) indicative of engine operating conditions, including exhaust gas composition;

c) oscillating the air/fuel ratio between a relatively rich level and a relatively lean level, the exhaust gas composition varying depending on the air/fuel ratio;

d) using the engine management system to reverse the direction of change of the air/fuel ratio when the exhaust gas composition is sensed as being indicative of rich engine operation or lean engine operation;

e) using the engine management system to determine the temporal characteristics of the oscillation in the air/fuel ratio; and f) using the engine management system to determine whether or not the engine is being fueled on the correct stroke by comparing said temporal characteristics with said relevant engine operation data.

The invention will now be further described, by way of example, with reference to the accompanying drawings, in which:

BRIEF DESCRIPTION OF THE DRAWINGS

FIGS. 3 and 4 are altered by fueling of the engine on the incorrect engine phase;

DETAILED DESCRIPTION OF THE PREFERRED EMBODIMENT

Figure 1:
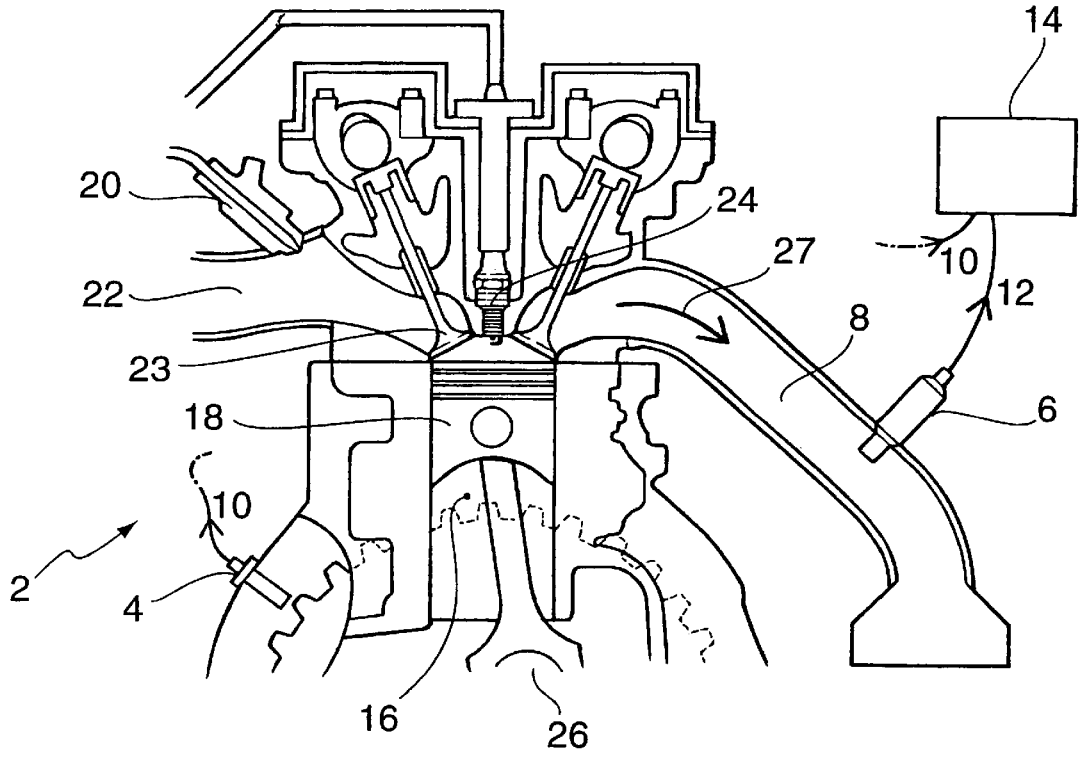
FIG. 1 is a schematic view of a four-stroke internal combustion engine according to the invention, having, a crank shaft sensor and an exhaust gas oxygen sensor in an exhaust outlet, both sensors providing a signal to an engine management system.

FIG. 1 shows a schematic view of a four-stroke internal combustion engine 2, having a crankshaft sensor 4 and an exhaust gas oxygen sensor 6 in an exhaust outlet 8, both sensors providing respective signals 10, 12 to an engine management system 14. Also shown in the drawing is a cylinder 16 with an associated piston 18 and indirect fuel injection means 20 for injecting a fine mist of fuel into the inlet conduit 22. Although in this drawing only one cylinder is shown, it should be understood that there will usually be more than one cylinder.

Air is supplied to the cylinder 16 via an inlet conduit 22, the air is mixed with fuel from the fuel injection means 20 in a ratio defined by the engine management system 14. This air/fuel mixture is then drawn into the cylinder 16, compressed by the piston 18 and ignited by a spark plug 24. The ignited air/fuel mixture expands and forces the piston down giving power to a crankshaft 26. Exhaust gases 27 created by this combustion event are expelled from the cylinder via the exhaust outlet 8, where the level of oxygen present in the exhaust gases is measured by the exhaust gas oxygen sensor 6. The exhaust gas oxygen sensor signal 12 is indicative of the level of oxygen in the exhaust gases. The engine management system 14 also receives a signal 10 from the crankshaft sensor 4, which enables the engine management system 14 to calculate the position of the crankshaft 26 and hence the position of the piston 16.

Figure 2:
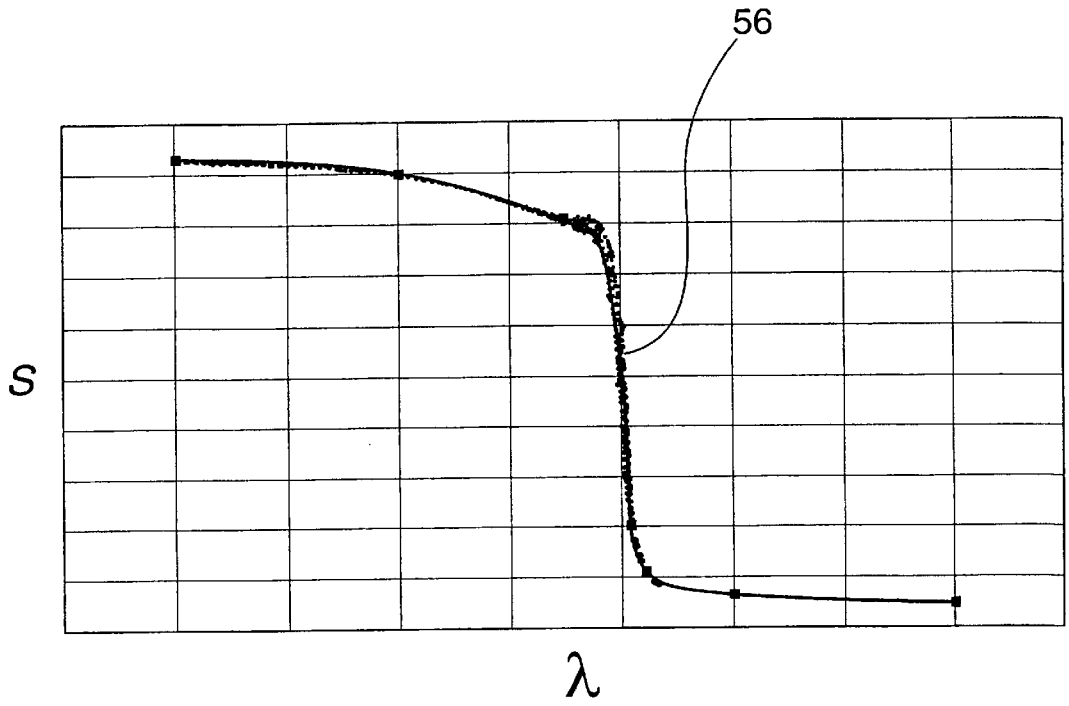
FIG. 2 is a plot of the output of the exhaust gas sensor against air/fuel ratio.

FIG. 2 shows a plot 56 of the output signal (S) 12 of the exhaust gas oxygen sensor 6 against air/fuel ratio $\lambda$. The air/fuel ratio $\lambda$ is defined as the actual air/fuel ratio divided by the air/fuel ratio needed for a chemical reaction in the correct stoichiometric ratio. As can be seen from the plot the sensor output signal 12 changes rapidly at an air/fuel ratio $\lambda=1$. This behaviour effectively makes the exhaust gas oxygen sensor 6 bi-stable. This means that this exhaust gas oxygen sensor 6 is suited for use in closed loop control of an engine with the air/fuel ratio being oscillated about the stoichiometric value $\lambda=1$.

Figure 3:
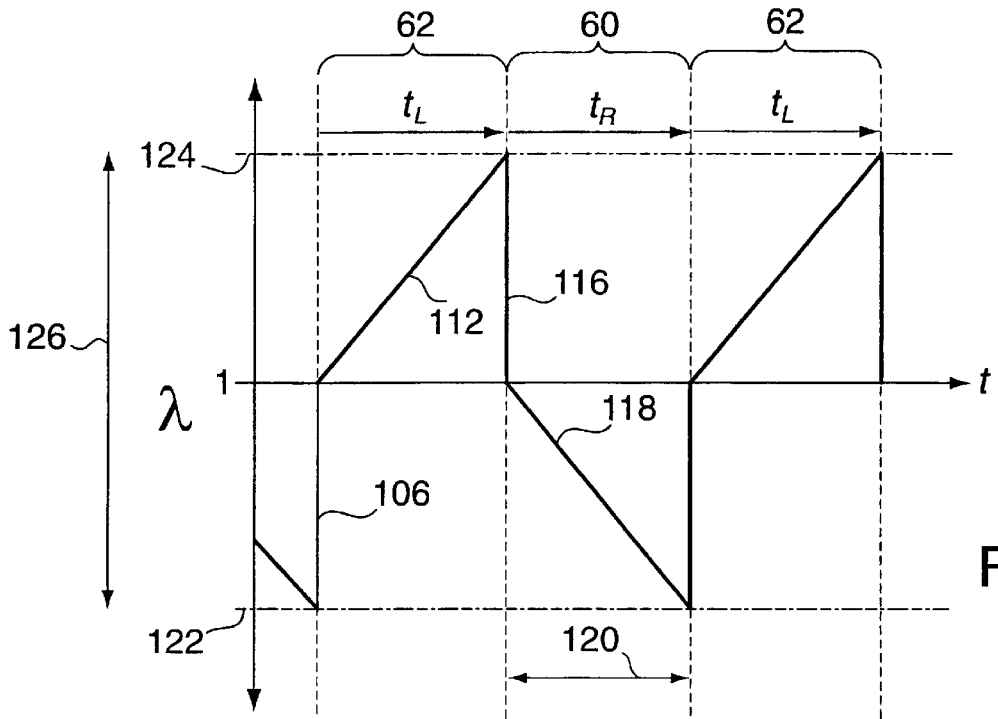
FIGS. 3 and 4 illustrate a conventional method of controlling air/fuel ratio close to a stoichiometric level for the purposes of emission reduction, showing respectively an idealised cyclic variation in air/fuel ratio and a corresponding ideal signal generated by the exhaust gas sensor.
Figure 4:
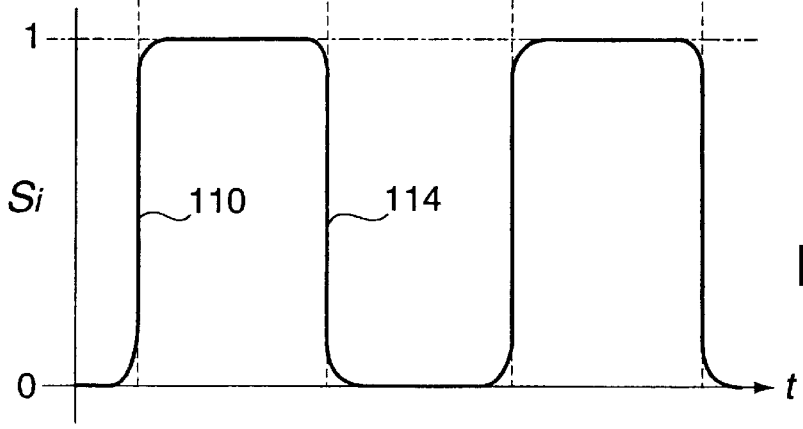

FIGS. 3 and 4 illustrate a conventional method of controlling air/fuel ratio $\lambda$ close to a stoichiometric level $\lambda=1$ for the purposes of emission control, showing respectively an idealised cyclic variation in air/fuel $\lambda$ against time (t) ratio and a corresponding ideal signal $S_i$ generated by the exhaust gas oxygen sensor 6. It can be seen from FIG. 3 that the air/fuel ratio $\lambda$ varies cyclically between a rich phase 60 ($\lambda<1$) and a lean phase 62 ($\lambda>1$). Starting at the beginning of one of the rich phases 60, the stoichiometric value is $\lambda=1$ and then falls at a constant rate for a time $t_R$. During this time $t_R$, the sensor output signal ($S_i$) 12 is steady at a low level $S_i=0$, indicating combustion products from earlier lean engine operation are still present in the exhaust outlet 8 around the exhaust gas oxygen sensor 6.

During time $t_R$, combustion products from rich operation are transported along the exhaust outlet 8 towards the exhaust gas oxygen sensor 6. The end of the rich phase occurs when these rich combustion products reach the exhaust gas oxygen sensor 6 the sensor signal $S_i$ rapidly switches from low $S_i=0$ to high $S_i=1$. This switch is detected by the engine management system 14 and, in response, the engine management system 14 causes the air/fuel ratio $\lambda$ to rise suddenly to the stoichiometric value $\lambda=1$. The air/fuel ratio $\lambda$ is steadily increased until the sensor output signal 12 suddenly changes from high $S_i=1$ to low $S_i=0$, in response to the combustion products from the lean operation reaching the exhaust gas oxygen sensor 6. At this point the air/fuel ratio $\lambda$ is dropped to the stoichiometric value $\lambda=1$ and then steadily falls.

This cycle continues while the closed loop control is still in force. The air/fuel ratio $\lambda$ varies between a relatively rich value 122 of about 0.96 and a relatively lean value 124 of about 1.04. This defines a standard operating range 126 for the air/fuel ratio $\lambda$. The time intervals 120 between the sudden changes in sensor output are related to the time delay for the combustion products to reach the exhaust gas oxygen sensor 6 following a change in engine conditions. This time delay 120 is called the transport delay time for the engine.

Figure 5:
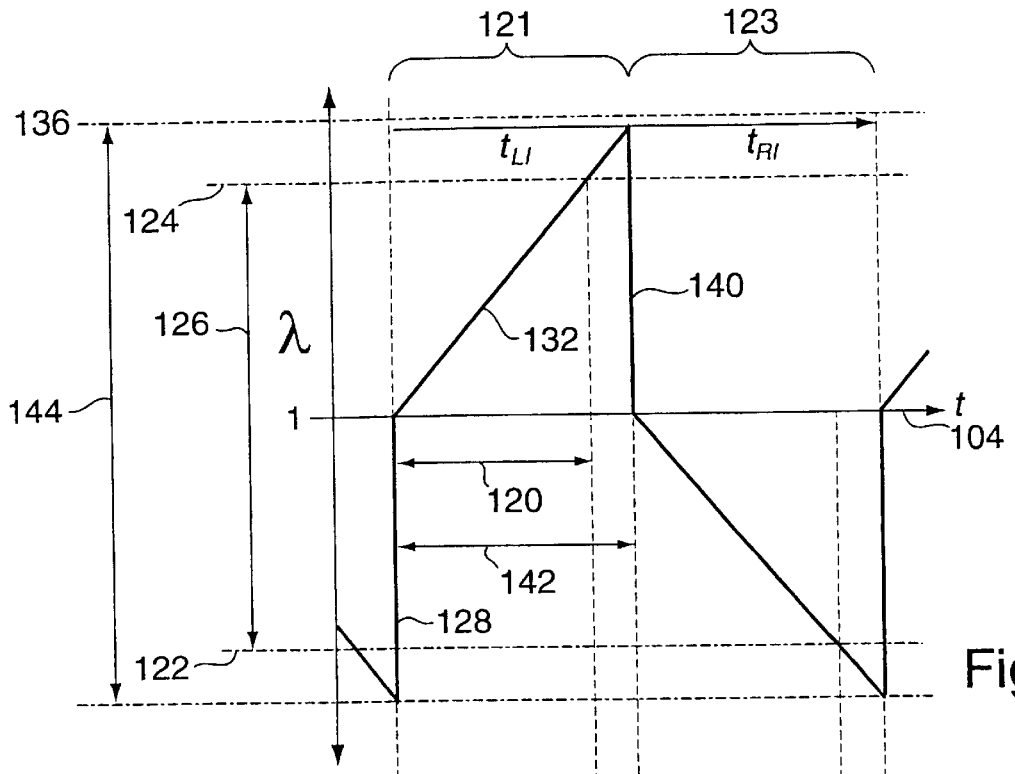
FIGS. 5 and 6 illustrate how
Figure 6:
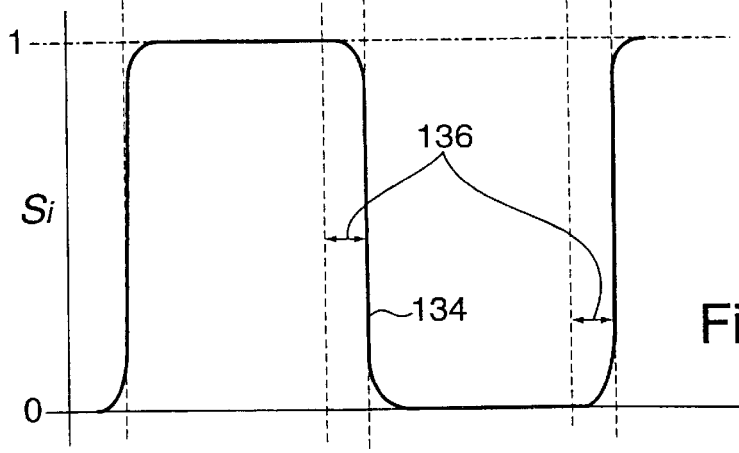

FIGS. 5 and 6 illustrate how FIGS. 3 and 4 are altered by fueling of the engine on the incorrect engine phase. Starting at the beginning of one of the lean phases 121, the stoichiomeric value is $\lambda=1$ and is increased at a constant rate for a time $t_{L1}$. During this time $t_{L1}$, the sensor output 12 is steady at a high level $S_i=1$, indicating combustion products from earlier rich engine operation are still present in the exhaust outlet 8 around the exhaust gas oxygen sensor 6. When the combustion products from the lean operation reach the exhaust gas oxygen sensor 6, the sensor output signal $S_i$ will change to low $S_i=0$ causing a change in the air/fuel ratio $\lambda$.

In this case, due to the fueling of the engine on the incorrect stroke, there is an additional time delay 136 between the engine management system 14 altering the air/fuel ratio $\lambda$ and the combustion products from this altered ratio affecting the sensor output signal 12. This additional time delay 136 is due to the fuel injection occurring at the incorrect engine phase, for example, near the end of the compression stroke, rather than near the end of the exhaust stroke. As a result, the inlet valve 23 is not open at or shortly after the injection of fuel into the air inlet 22, and the fuel pools behind the inlet valve 23. When the inlet valve 23 opens this pool is drawn into the cylinder 16. Since the fuel is no longer in a fine mist when it enters the cylinder 16, the combustion event will be less efficient. The additional time delay 136 measured is the time between the injection of the fuel and the introduction of the fuel into the cylinder 16.

The increased time delay 142 between these sudden changes in engine condition for the incorrectly fueled engine is greater than the time delay 120 in the correctly fueled engine. This leads to the air/fuel ratio $\lambda$ varying over a range 144 than is the case for a correctly fueled engine.

Figure 7:
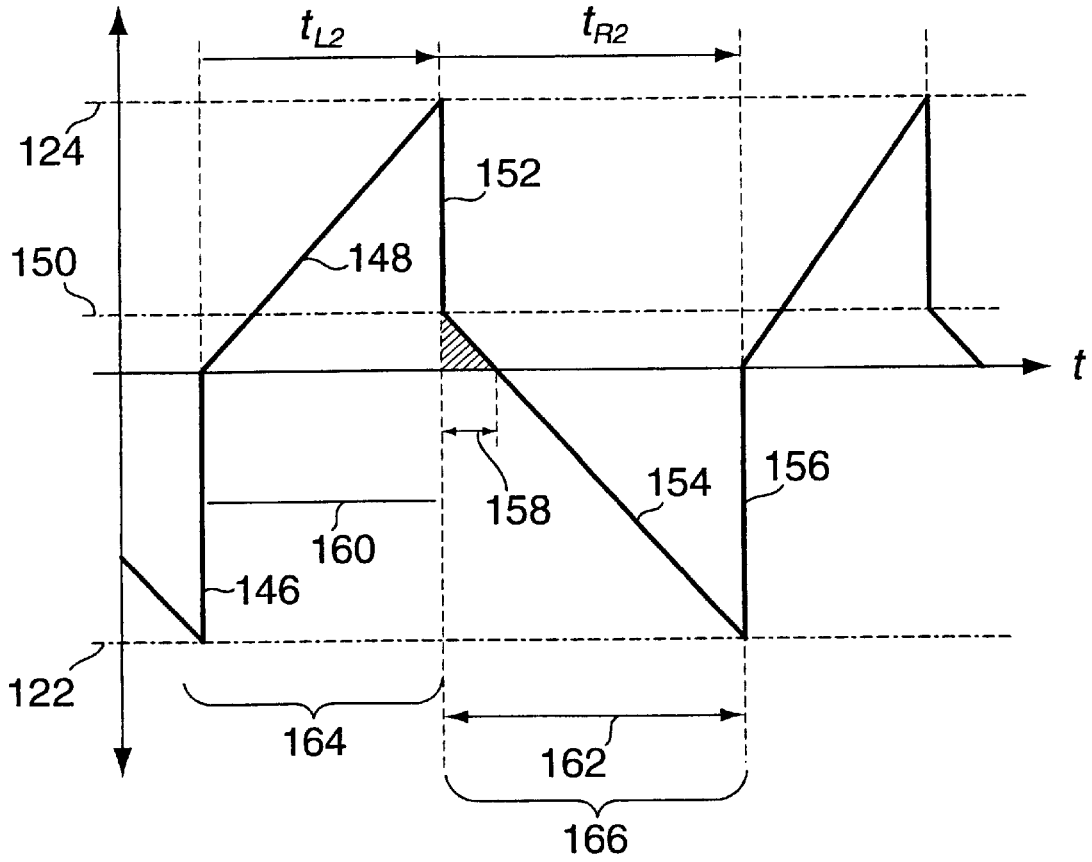
FIG. 7 shows how the variation in air/fuel ratio changes when the engine is set to run for lean operation.

FIG. 7 shows how the variation in air/fuel ratio $\lambda$ changes when the engine is set to run for lean operation. Starting at the beginning of one of the lean phases 164, the air/fuel ratio is the stoichiometric value $\lambda=1$ and then rises at a constant rate for a time $t_{L2}$. When the combustion products from this lean operation reach the exhaust gas oxygen sensor 6 and the sensor signal 12 changes from high $S_i=1$ to low $S_i=0$ the engine management system 14 drops the air/fuel ratio to a level above the stoichiometric value $\lambda=1$. The air/fuel ratio then falls at a steady rate to begin rich operation of the engine during a time $T_{R2}$ until a further sensor switch is detected. When the air/fuel ratio $\lambda$ suddenly rises to the stoichiometric level $\lambda=1$ and begins to rise steadily.

The extra period of lean fueling 158 gives rise to a measured transport delay time which can take one of two values 160, 162. During the cycle with no extra lean fueling 164, the time delay 160 is less that the time delay 162 due to the period of extra lean fueling 158 occurring during the cycle 166.

It has been found during test track evaluation of a motor car incorporating the invention, that this lean bias effect does not cause problems in the verification of whether or not the engine is fueled on the correct stroke.

Figure 8:
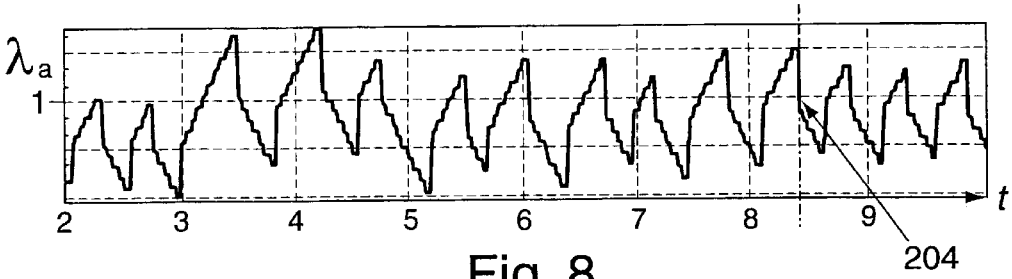
FIGS. 8, 9 and 10 show plots of real data from an internal combustion engine for, respectively, the measured inlet air fuel ratio, the exhaust gas sensor signal, and a count of engine cycles between points where the signal from the exhaust gas sensor alternates.

FIG. 8 shows a plot of real data taken during evaluation of the motor car incorporating the invention. The plot shows that the measured air/fuel ratio $\lambda_a$ against time t has a "saw-tooth" shape. This is to be expected from the conventional method of closed-loop control of an engine outlined above. This plot shows that there is significant noise in the sensor outputs that could potentially affect the results. In this case, it can be seen that the measured air/fuel ratio $\lambda_a$ does not oscillate symmetrically above and below about the stoichiometric value $\lambda_a=1$. A typical jump in the air/fuel ratio is highlighted 204 to show that even with the associated signal noise it is possible to define a point at which the sudden jump in the air/fuel ratio occurs. This then allows the calculation of the time taken between these jumps so that the fueling stroke of the engine can be verified.

Figure 9:
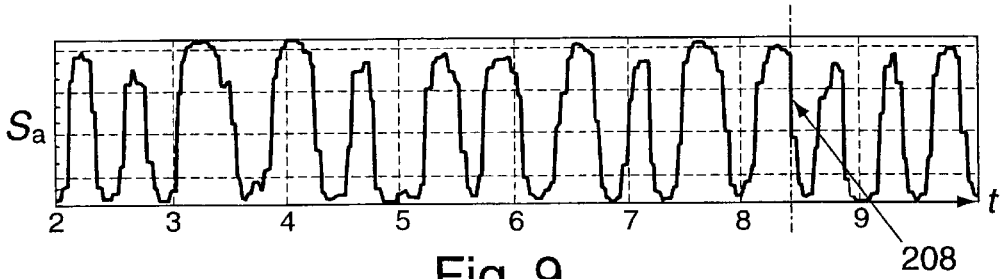

FIG. 9 shows the actual exhaust gas sensor output $S_a$ associated with the plot in FIG. 8. The inherent noise in the system can be seen since the plot is not regular. A typical change in the sensor output is highlighted 208 to show that the sensor switch point can be determined even through signal noise. This allows the engine management system 14 to determine the time at which the switch in engine operating conditions should occur.

Figure 10:
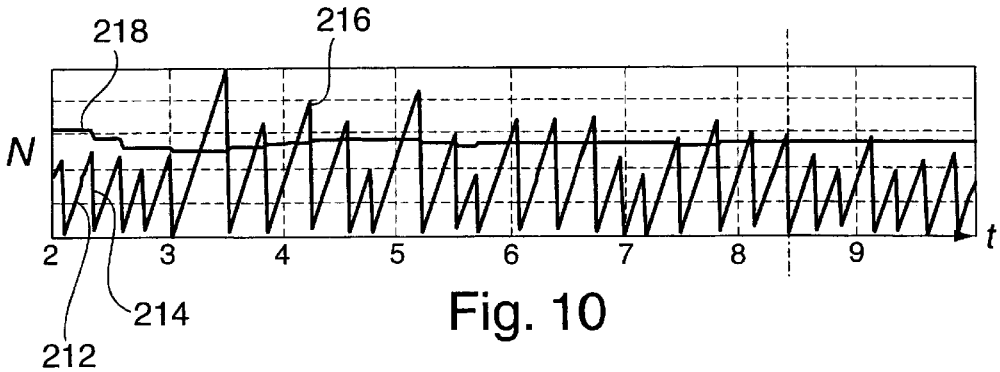

FIG. 10 shows the counted number of engine cycles N between the sensor switches rising 212 and being reset 214 when a sudden change in sensor output is detected. The plot 218, represents the expected number of engine cycles between the sensor switch events. As can be seen, the actual number of engine cycles between sensor switches, defined by the height of the peaks 216 in the plot of engine cycle count N against time t, varies above and below the expected number of cycles 218. The difference between the peak height 216 and the expected number of engine cycles. 218 defines an error. This error could be due to noise, or due to incorrect fueling of the engine producing an associated extra transport time delay.

Figure 11:
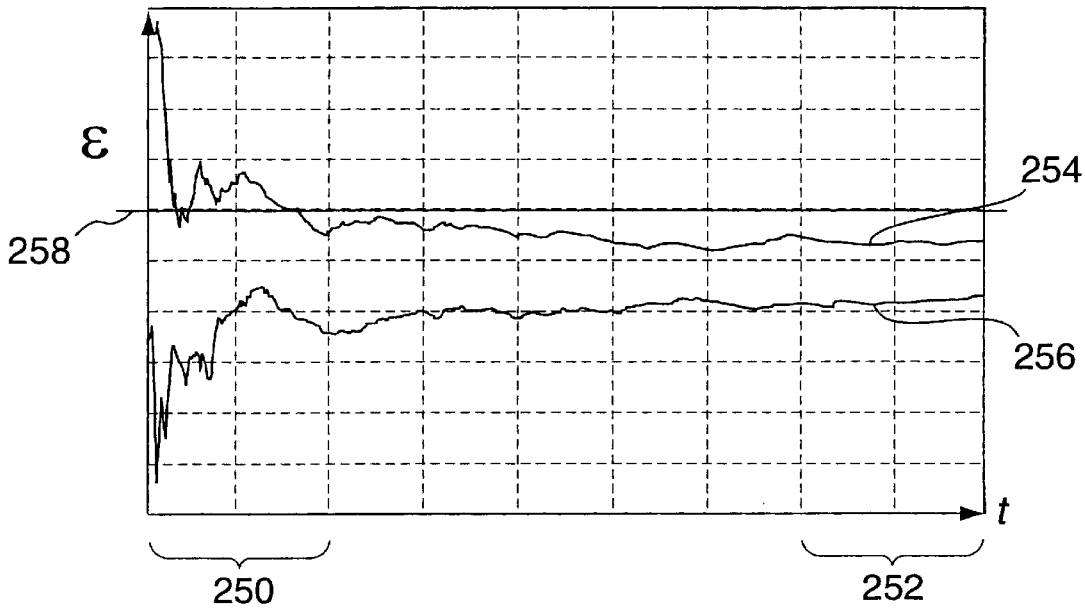
FIGS. 11 and 12 show plots of real data, respectively, of how the count of engine cycles in FIG. 10 can be averaged over time to distinguish between in-phase and out-of-phase engine operation, and how these counts change with engine speed.

FIG. 11 shows how a cumulative average difference $\lambda$ between the actual number of engine cycles and the expected number of engine cycles between the sudden changes in sensor output, as calculated from FIG. 10, may be averaged to lessen the effects of noise in the system. There are two plots 254,256 shown in FIG. 11. The first plot 254 is obtained from an engine being correctly fueled and the second plot 256 is obtained from an engine being incorrectly fueled. These plots show how the average errors, for a test carried out at a constant engine speed, converge over time 201. Initially, [250] the difference 250 varies greatly, but the later difference 250 is relatively steady. The plot 254 from the correctly fueled engine is consistently closer to a zero difference line 258 than the plot 256 from the incorrectly fueled engine. This shows that after averaging the difference between the expected delay time and the actual delay time it is possible to differentiate between a correctly fueled engine and an engine that is being incorrectly fueled, by the mean error away from the zero differences line 258.

Figure 12:
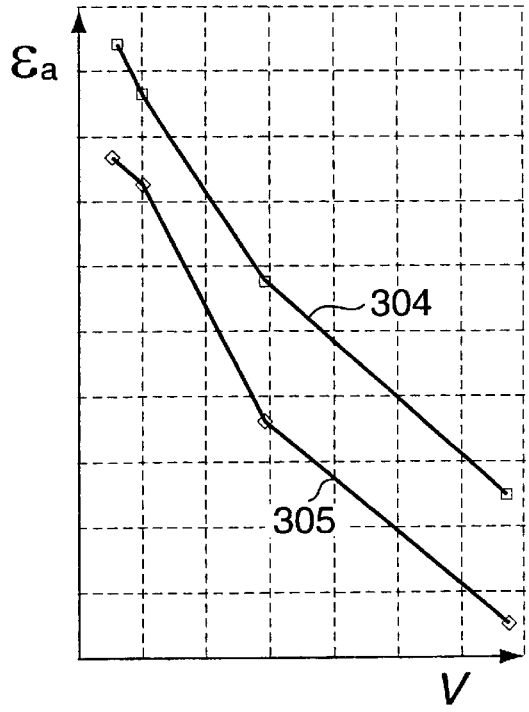

FIG. 12 shows two plots 304,305 of the variation in the average difference $\lambda_a$, over a number of readings, between the expected and actual number of engine cycles between the sudden changes in sensor output as shown in FIG. 11 and the engine speed V. Both plots 304,305 show that the average difference $\lambda_a$ decreases as engine speed V increases. The plot 304 from an engine that is correctly fueled is consistently above the plot 305 from an engine that is being incorrectly fueled. As a result of this distinct difference, an engine can be characterized over a wide range of engine operating conditions in terms of the time taken between the sudden changes in engine output for both correct phase fueling and incorrect phase fueling. Once such a characterisation has been made, it is possible to establish whether or not the engine is being correctly fueled by analysing the frequency or period of the sudden changes in exhaust gas sensor output, and then comparing this with an expected frequency or period.

Figure 13:
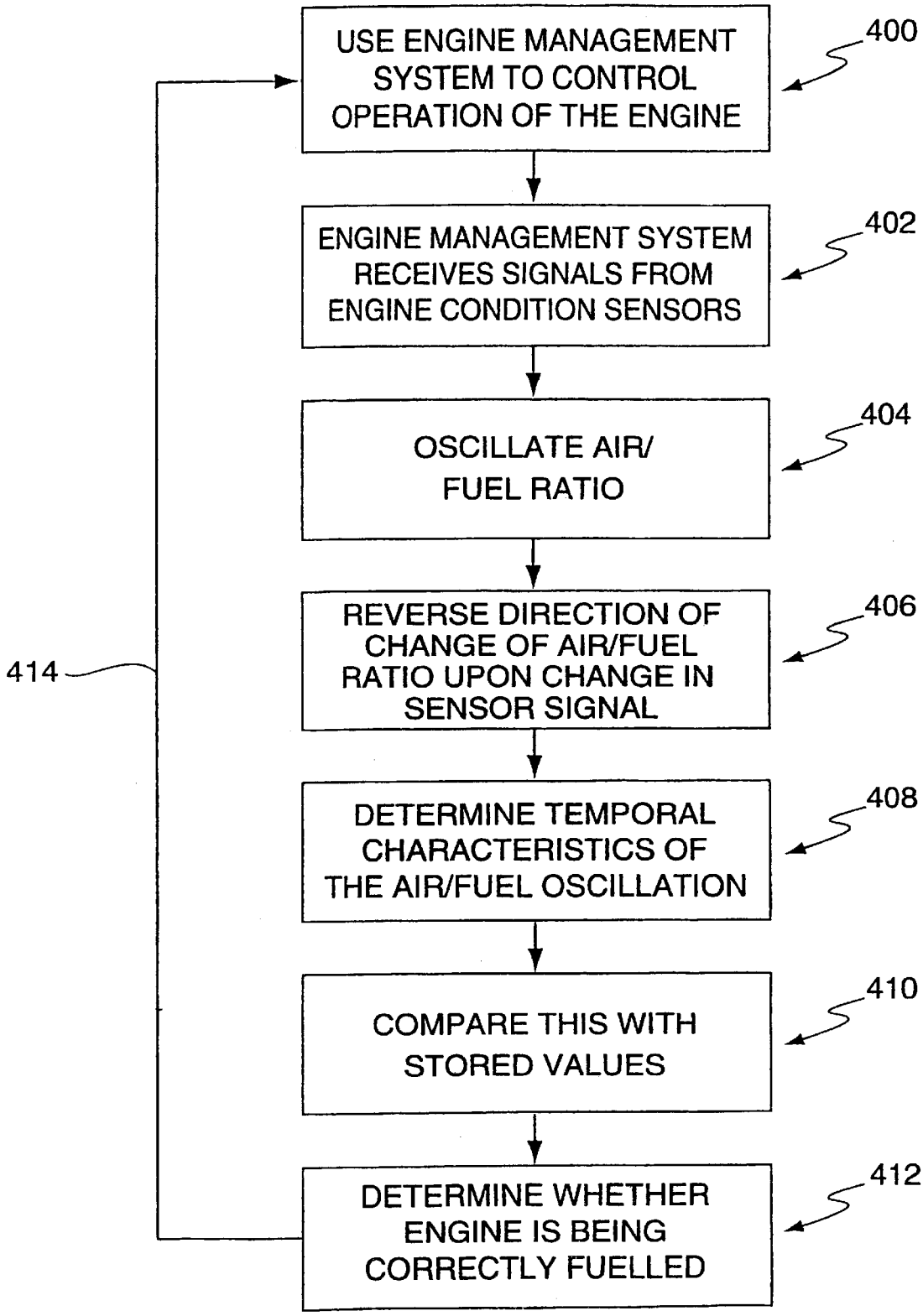
FIG. 13 shows a flow chart illustrating a method according the invention for determining whether or not the engine is being fueled on the correct stroke.

FIG. 13 shows a flow chart illustrating a method according the invention for determining whether or not the engine is being fueled on the correct stroke.

The engine management system is used to control the operation of the engine 400 including the fuel injection system and the air/fuel ratio for at least one cylinder.

The engine management system receives signals 402 indicative of the engine operating conditions from sensors positioned around the engine, including at least one exhaust gas composition sensor.

The air/fuel ratio is oscillated 404 between a relatively rich level and a relatively lean level, the exhaust gas composition varying depending on the air/fuel ratio.

The direction of change of the air/fuel ratio is reversed 406 when the exhaust gas composition is sensed as being indicative of rich engine operation or lean engine operation.

The temporal characteristics of the oscillation in the air/fuel ratio are then determined 408 and this temporal characteristic is then compared 410 with stored engine operating condition data, in order to determine 412 whether or not the engine is being fueled on the correct stroke. The cycle then returns 414 to the start.

If it is determined that the engine is being incorrectly fueled, the engine management system can then be used to adjust automatically the fueling stroke of the engine.

The invention therefore provides a convenient way to sense and correct fueling on an incorrect stoke of the engine.

What is claimed is:

1. An internal combustion engine, comprising a number of cylinders, the or each cylinder containing a four-stroke reciprocating piston, an exhaust conduit, one or more engine operating condition sensors including an exhaust gas sensor in the exhaust conduit for measuring the composition of the exhaust gas, a fuel injection system, and an engine management system for controlling the operation of the engine including the fuel injection system and the air/fuel ratio for at least one cylinder, wherein the engine management system contains engine operation data, the engine operation data being related to expected engine operation with engine fueling on the correct stroke and/or engine fueling on an incorrect stroke, and the engine management system is arranged to:

a) receive from said sensor(s) respective signal(s);

b) oscillate the air/fuel ratio between a relatively rich level and a relatively lean level, the exhaust gas composition varying depending on the air/fuel ratio;

c) reverse the direction of change of the air/fuel ratio when the exhaust gas composition is sensed as being indicative of rich engine operation or lean engine operation;

d) determine the temporal characteristics of the oscillation in the air/fuel ratio; and e) determine whether or not the engine is being fueled on the correct stroke by comparing said temporal characteristics with said relevant engine operation data.

2. A method of operating an internal combustion engine the engine comprising a number of cylinders, the or each cylinder containing a four-stroke reciprocating piston, one or more engine operating condition sensors including an exhaust gas sensor, a fuel injection system, and an engine management system, wherein the engine management system contains engine operation data, the engine operation data being related to expected engine operation with engine fueling on the correct stroke and/or engine fueling on an incorrect stroke, wherein the method comprises the steps of:

a) using the engine management system to control the operation of the engine including the fuel injection system and the air/fuel ratio for at least one cylinder;

b) sending to the engine management system from said sensor(s) respective signal(s) indicative of engine operating conditions, including exhaust gas composition;

c) oscillating the air/fuel ratio between a relatively rich level and a relatively lean level, the exhaust gas composition varying depending on the air/fuel ratio;

d) using the engine management system to reverse the direction of change of the air/fuel ratio when the exhaust gas composition is sensed as being indicative of rich engine operation or lean engine operation;

e) using the engine management system to determine the temporal characteristics of the oscillation in the air/fuel ratio; and f) using the engine management system to determine whether or not the engine is being fueled on the correct stroke by comparing said temporal characteristics with said relevant engine operation data.

3. A method as claimed in claim 2, comprising the additional steps of calculating the engine management system transport delay time from the period or frequency of the reversal of the oscillation in the air/fuel ratio, this transport delay time being indicative of the time taken for a change in engine operating conditions to alter the composition of the exhaust gas at the exhaust gas sensor, this transport delay time; and comparing the engine management transport delay with the engine operation data stored in the engine management system to determine whether or not the engine is being fueled on the correct stroke.

4. A method as claimed in claim 2, wherein the exhaust sensor is an exhaust gas oxygen sensor.

5. A method as claimed in claim 2, wherein the period or frequency of the reversal cycle data is averaged over a plurality of oscillations in the air/fuel ratio.

6. A method as claimed in claim 2, wherein the period or frequency data of an oscillation in the air/fuel ratio is ignored by the engine management system if said period or frequency is outside a pre-determined range.

7. A method as claimed in claim 2, wherein the engine management system has a range of pre-determined engine operating conditions during which it calculates the period or frequency of the reversal cycle or the transport delay and stores it for future reference.

8. A method as claimed in claim 7, wherein the stored period or frequency of the reversal cycle or the transport delay is used to calculate an average error for those particular engine operating conditions for which data is recorded and using the engine management system to determine whether or not the engine is being fueled on the correct stroke by comparing said temporal characteristics with said relevant engine operation data.

* * * * *